United States Patent [19]

Parkes

[11] 4,061,398

[45] Dec. 6, 1977

[54] HYDRAULIC MINING APPARATUS AND METHOD

[75] Inventor: David M. Parkes, Calgary, Canada

[73] Assignee: Kaiser Resources Ltd., Canada

[21] Appl. No.: 702,072

[22] Filed: July 2, 1976

[30] Foreign Application Priority Data

Apr. 6, 1976 Canada ..... 246968

[51] Int. Cl.[2] ..... E21C 35/22

[52] U.S. Cl. ..... 299/17; 241/81; 241/76; 241/186 R; 299/8; 299/18

[58] Field of Search ..... 241/186 R, 154, 81, 241/76; 302/14, 15; 209/261, 307, 257; 299/8, 17, 18, 7

[56] References Cited

U.S. PATENT DOCUMENTS

| | | | |
|---|---|---|---|
| B 425,462 | 3/1976 | Umphrey | 241/81 |
| 433,777 | 8/1890 | Skinner | 241/81 |
| 2,267,419 | 12/1941 | Oster | 209/257 X |
| 3,790,214 | 2/1974 | Kilroy | 299/8 |
| 3,924,895 | 12/1975 | Leasure | 299/8 |
| 3,951,457 | 4/1976 | Redford | 299/17 X |

*Primary Examiner*—Ernest R. Purser
*Assistant Examiner*—William F. Pate, III
*Attorney, Agent, or Firm*—Naylor, Neal & Uilkema

[57] ABSTRACT

An hydraulic mining apparatus and method wherein the mined aggregate is separated into dry, relatively large aggregate pieces for dry conveyance and wet, relatively small aggregate pieces for wet conveyance. In the preferred embodiment, the method and apparatus provides for reducing any oversized large aggregate pieces in size so that the large pieces do not exceed a predetermined maximum size. Size reduction is provided by a mechanical breaker and wet, relatively small aggregate is separated out of the mined product prior to the breaking step. The apparatus is embodied in a feeder-breaker mechanism wherein a conveyor running lengthwise of the mechanism first subjects the total mined product to size separation or classification, then directs the larger aggregate pieces through the breaker and, finally, discharges the breaker treated pieces to a dry conveyor. The separated wet, relatively small aggregate pieces are collected within the mechanism and pumped away.

8 Claims, 4 Drawing Figures

HYDRAULIC MINING APPARATUS AND METHOD

BACKGROUND OF THE INVENTION

The present invention relates to an apparatus and method for hydraulically mining friable material such as coal, tar sands, and uranium and, more particularly, is concerned with the handling and conveyance of such material once broken loose from its in situ state.

In its more specific aspects, the invention is concerned with an improvement of the apparatus and method forming the subject of United States Patent Application Ser. No. 597,985, filed July 22, 1975, by Arthur W. T. Grimley, (corresponding to Canadian Patent Application Ser. No. 212,253, filed Oct. 25, 1974). That application discloses an hydraulic mining apparatus and method wherein a feeder-breaker mechanism is provided with two jet monitors, one of which is provided for dislodging in situ material from a mine and the other of which is provided for breaking up dislodged material for handling purposes. The feeder-breaker shown in the application includes a conveyor extending over the length of the apparatus and a breaker disposed intermediate the ends of the conveyor to reduce mined aggregate in size. Ultimately, the conveyor discharges the treated material into a flume, from whence, together with water in the flume, it travels under the influence of gravity.

The apparatus and method of the present invention is an improvement over that of aforementioned Application Ser. No. 597,985 in that it provides for the separation of the mined material into a pumpable constituent and a dry, conveyable constituent. As a result, the material treated by the feeder-breaker mechanism of the present invention is not dependent upon gravity transport in a flume. This, in turn, means that the apparatus and method of the invention may be used in environments where the grade within the mine being worked is insufficient to effectively support gravity transport within a flume.

SUMMARY OF THE INVENTION

The basic element of the present invention comprises a conveyor having upstream and downstream sections, at least the upstream section of which is preforate, whereby fluid and mined aggregate of a predetermined size or less is separated out as the aggregate is conveyed over the section. A breaker is disposed intermediate the upstream and downstream sections to reduce the size of any oversize aggregate passing from the upstream section to the downstream section and collection means is disposed beneath the upstream section to collect the aggregate and fluid there separated out. A pump is provided to convey fluid and aggregate which collects in the collection means and a secondary conveyor is provided to convey away the large, relatively dry, aggregate discharged from the downstream section of the apparatus.

In the preferred embodiment, the feeder-breaker of the apparatus also includes a first jet monitor at its upstream end for dislodging material from a mine within which the apparatus is working and second jet monitor carried by the apparatus intermediate the upstream and downstream sections of the conveyor for breaking up dislodged mined material disposed around and on the apparatus.

In its broadest aspects, the method of the invention is concerned with the treating and conveying of hydraulically mined aggregate by the steps comprising: conveying the aggregate over an elongate, continuous conveyor having upstream and downstream sections, separating fluid and aggregate of a predetermined size or less at the upstream section while conveying aggregate greater than said predetermined size through a breaker to reduce the size thereof; collecting fluid and aggregate separated out at the upstream section and conveying the same away by pumping; and, conveying on the downstream section of the conveyor the aggregate reduced in size by the breaker. The overall method thus provided results in a pumpable constituent comprised of relatively small aggregate particles and fluid and a dry, conveyable constituent comprised of relatively large particles of generally uniform size.

OBJECTS OF THE INVENTION

The principal object of the invention is to provide an apparatus and method for hydraulic mining wherein the mined product is treated and separated or classified into constituent parts which are not dependent upon gravity for their conveyance.

Another and related object of the invention is to provide such an apparatus and method wherein one of the constituent parts is pumpable and the other is ideally suited for dry conveyance by a belt conveyor or the like.

Still another object of the invention is to provide a feeder-breaker apparatus wherein relatively small particles suitable for conveyance by pumping are separated out prior to being subjected to breaking or crushing operations which would further reduce their size.

A further object of the invention is to provide a feeder-breaker apparatus incorporating jet monitors which provide for both the dislodging of material from the mine within which the apparatus is being used and the breaking up of oversize material once it is dislodged.

The foregoing and other objects will become more apparent when viewed in light of the following detailed description and the accompanying drawings.

DESCRIPTION OF THE PREFERRED EMBODIMENT

Figure 1:
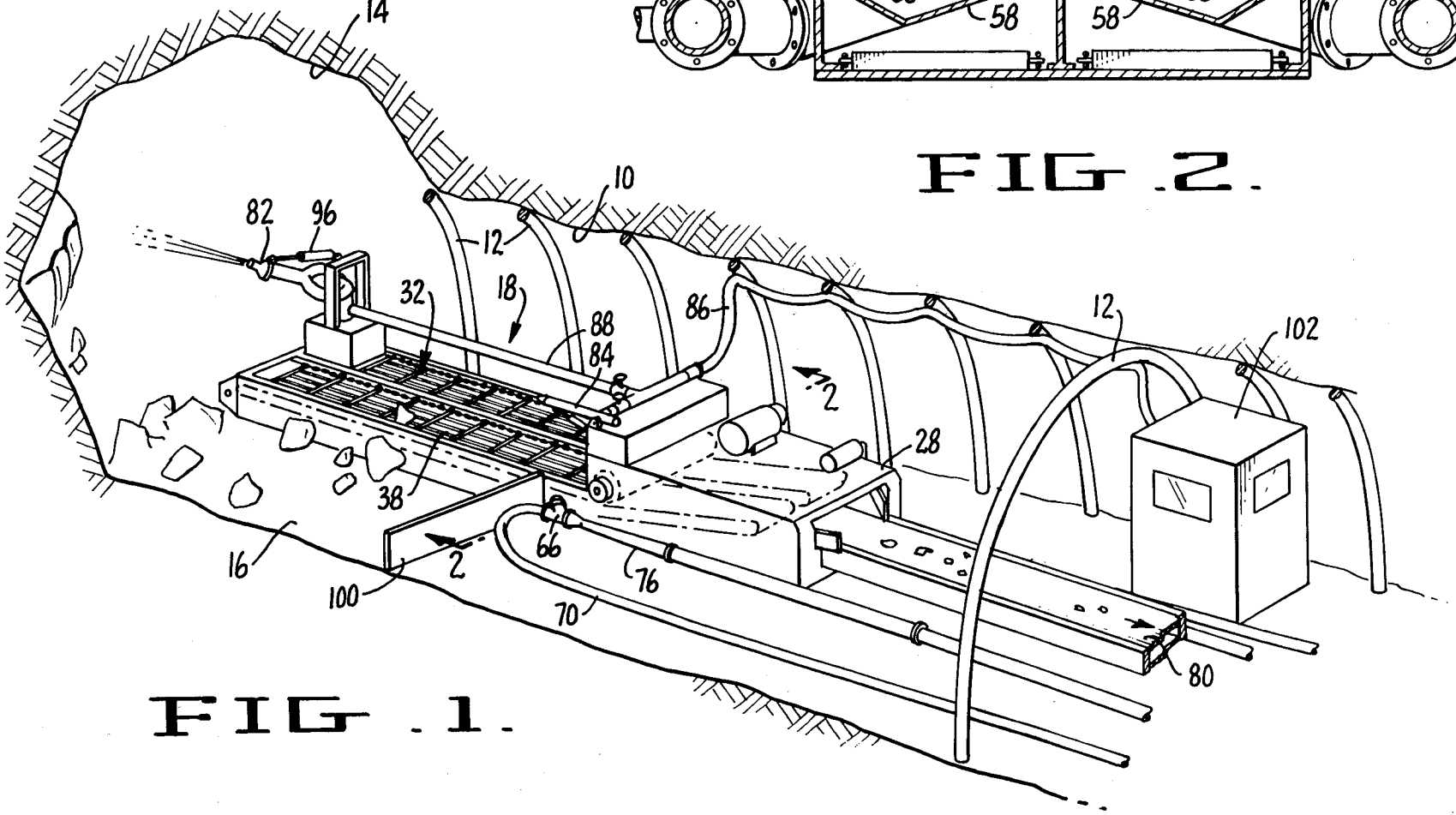
FIG. 1 is a perspective view of the feeder-breaker of the present invention, as it would appear within a mine.

As shown in FIG. 1, the feeder-breaker is illustrated within a mine shaft or entry 10. The roof of the shaft is shown as being supported by arches 12 and the enlarged area of the mine being cut away by the dislodging monitor of the apparatus is designated by the numeral 14. The floor of the shaft is designated by the numeral 16.

The feeder-breaker apparatus of the invention is designated in its entirety by the numeral 18. The apparatus comprises a chassis 20 in the form of a pan-like structure supported on the floor 16. As shown, the chassis comprises a bottom 22, a forward end 24, a cutaway rearward end 26 and a top platform 28. From FIG. 4, will be appreciated that the top of the chassis is open over the majority of the length thereof, said open portion being designated 30. Although not illustrated in detail, it should be understood that the chassis is provided with suitable superstructure so that it is self-supporting and so that the chassis may be moved about without being adversely distorted. Typically, the chassis would be moved into place by either pushing or pulling through means of a suitable traction vehicle, or by winch mounted upon the chassis.

A continuous conveyor runs lengthwise of the chassis and comprises: a closed loop perforate chain conveyor 32 trained over sprockets 34 and 36 extending transversely across and supported by the chassis proximate its forward and rearward ends, respectively; a wedge wire grid 38 extending beneath the upstream end of the upper reach of the chain conveyor; and, an imperforate plate 40 extending beneath the downstream end of the upper reach of the chain conveyor. The grid 38 and plate 40 are fixedly supported on the chassis 20 and the upper reach of the chain conveyor 32 is disposed to slidably move thereover. The sprockets 34 and 36 are mounted on the chassis for rotation about axes extending generally transversely thereof and drive motor 42 is mounted on the platform 28 and drives the sprocket 36 in a clockwise direction through means of a chain drive 44. The arrow lines in FIG. 4 indicate the direction of travel of the upper reach of the belt and the direction of rotation of the sprockets 34 and 36.

Figure 3:
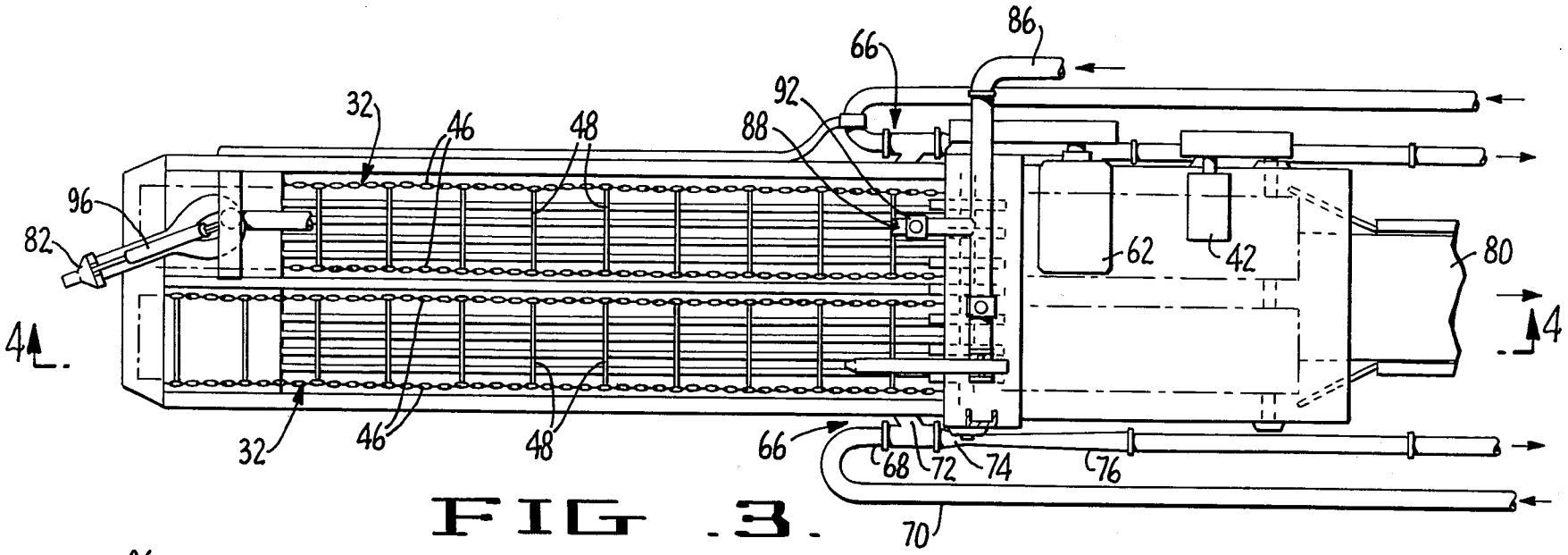
FIG. 3 is a plan view of the feeder-breaker of the present invention.
Figure 4:
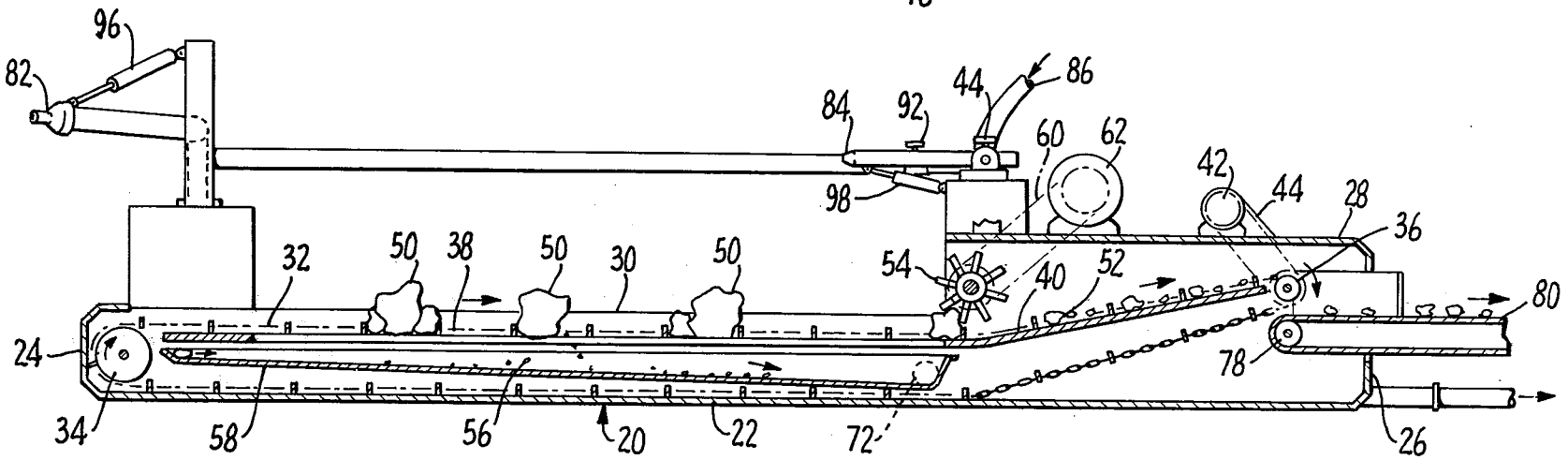
FIG. 4 is a cross-sectional elevational view of the feeder-breaker, taken on the plane designated by Line 4—4 in FIG. 3.

The chain conveyor 32 is comprised of two sections, each of which extends lengthwise of the feeder-breaker, as may be seen from FIG. 3. Each section comprises a pair of chains 46 trained over the sprockets 34 and 36 and a plurality of bars 48 extending transversely between the chains thereof. The bars 48 function to drag aggregate pieces being processed over the upper surfaces of the grid 38 and plate 40. Such pieces are exemplified in FIG. 4 and designated by the numeral 50 at the upstream portion of the apparatus and the numeral 52 at the downstream portion of the apparatus. The difference in size between the pieces 50 and 52 is explained by the fact that a rotary breaker 54 is provided intermediate the upstream and downstream sections of the conveyor to reduce the size of the aggregate pieces which pass to the downstream section. The numeral 56, in FIG. 4, depicts aggregate pieces which have fallen through the grid 38. These pieces are of relatively small size and collect within a collection sump 58 supported by the chassis 20 intermediate the upper and lower reaches of the chain conveyor 32 and beneath the grid 28.

The rotary breaker 54 may be of the same general construction as that disclosed in aforementioned Application Ser. No. 597,985. It is supported on the chassis 22 for rotation about an axis extending transversely of the chassis and is driven through a chain drive 60 by a motor 62 supported on the platform 28.

Figure 2:
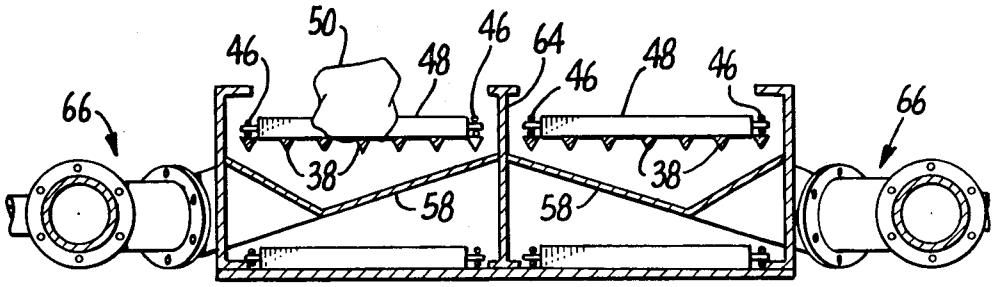
FIG. 2 is a cross-sectional view through the upstream section of the feeder-breaker, taken on the plane designated by Line 2—2 of FIG. 1.

As can best be seen from FIG. 4, the sump 58 is of elongated panlike configuration and slopes downwardly from the forward end (left end, as viewed in FIG. 4) to the rearward end of the apparatus. Although referred to in the singular sense, it will be appreciated from FIG. 2 that the sump actually comprises a pair of troughlike pans or trays and that a partition 64 separates the respective troughlike trays. The lowermost end of each tray of the sump 58 communicates with a jet pump 66 whereby fluid and aggregate particles which collect in the lower end of the sump are exhausted therefrom and pumped away. The jet pumps 66 are of relatively conventional construction and may be of the type marketed under the name HYJECTOR by Babcock Hydro-Pneumatics of London, England, a member of the Babcock & Wilcox, Ltd., group of companies. Each jet pump comprises: a nozzle inlet 68 to which water under pressure is supplied by a feed line 70; an inlet 72 for receipt of the material collected within the sump 58; and, a throat discharge 74 communicating with a discharge conduit 76 provided to receive and convey away material from the sump by the jet pump. The arrow lines in FIG. 3 indicate the direction of flow of the fluid in the feed lines 70 and discharge conduits 76.

The chassis 20 also carries a support roller 78 for a conveyor belt 80 disposed to receive the aggregate pieces 52 as they spill over the downstream end of the conveyor belt 32. Although not illustrated, it should be understood that the belt 80 would be suitably driven in the direction shown by the arrow line in FIG. 4 and that the downstream end of the belt would be supported on a support roller. The length of the conveyor 80 and the manner in which it discharges or cooperates with other conveyors would depend upon the set-up of the mine being worked.

The basic structure of the feeder-breaker apparatus is completed by a principal jet monitor 82 mounted on the forward end of the apparatus and a secondary jet monitor 84 mounted on the apparatus at a location generally above the breaker 54. The monitors are provided with high-pressure water through a main supply conduit 86. The conduit 86 branches to a supply conduit 88 for the monitor 82 and a supply conduit 90 for the monitor 84. Control valves 92 and 94, respectively, are provided in the conduits 88 and 90.

The monitor 82 is the principal working monitor of the breaker-feeder and is provided for the purpose of dislodging material from the mine being worked. The enlarged area 14 is intended to depict an area which has been so worked. A cylinder 96 is provided for selectively controlling the direction of the monitor.

The monitor 84 is provided for the purpose of breaking up large aggregate pieces once they have been dislodged and have collected either on the floor of the mine or the forward portion of the feeder-breaker. A cylinder 98 is provided to control the direction of the monitor 84. Because of its more limited function the angle through which the monitor 84 may be swung is considerably more limited than that of the monitor 82.

The supporting structure for the feeder-breaker apparatus also includes barriers disposed between the apparatus and the sides of the mine shaft, one such barrier being seen in FIG. 1 and designated by the numeral 100. The apparatus also is provided with a control station 102, generally located somewhat to the rear and one side, as illustrated in FIG. 1. An operator is located within the control station and from there remotely controls the operation of the various parts of the feeder-breaker mechanism.

CONCLUSION

From the foregoing detailed description, it is believed apparent that the invention enables the obtainment of the objects initially set forth herein. In particular, it provides a method and apparatus wherein the mined material is selectively separated into constituents ideally suited for conveyance by pumping or dry conveyor and wherein the constituents for dry conveyance may be reduced in size to obtain optimum operation.

Although a preferred embodiment of the invention has been illustrated and described, it should be understood that the invention is not intended to be limited to that embodiment, but rather is defined by the accompanying claims.

What is claimed is:

1. An hydraulic mining apparatus comprising, in combination: a perforate continuous loop belt conveyor having upstream and downstream sections and a reach extending over the length of said sections, the belt of said conveyor being sufficiently open to permit the substantially unrestricted passage of mined aggregate therethrough and having an upstream support extending beneath said reach over the length of said upstream section and a downstream support extending beneath said reach over the length of said downstream section, said upstream support having openings therein sized to permit fluid and aggregate of a pumpable size to pass therethrough while preventing the passage therethrough of aggregate greater than pumpable size, said downstream support being substantially imperforate whereby aggregate carried by said downstream section is supported on said downstream support and discharges over the distal end of said section; breaker means disposed intermediate said sections to reduce the size of any oversized aggregate passing from said upstream section to said downstream section; collection means disposed beneath said upstream section to collect fluid and pumpable aggregate separated out at said upstream section; pump means communicating with said collection means to withdraw and pump fluid and aggregate therefrom and convey the same under pressure; and an aggregate carrying conveyor disposed at the discharge end of said downstream section to receive and convey aggregate discharged over the distal end of said section.

2. An apparatus, according to claim 1, wherein the pump means comprises a jet pump having an inlet in fluid communication with said collection means.

3. An apparatus, according to claim 1, wherein the breaker means is disposed over said reach of the conveyor and comprises a rotary breaker disposed to rotate about an axis generally normal to the direction of travel of the conveyor.

4. An apparatus, according to claim 1, wherein said upstream support comprises wedge wires extending longitudinally of conveyor and spaced from one another by a distance sufficient to permit aggregate of a pumpable size to pass therethrough, while preventing the passage therethrough of aggregate greater than pumpable size.

5. An apparatus, according to claim 1, wherein the belt of said conveyor has upper and lower reaches, the upper of which imparts movement to aggregate being conveyed by the conveyor and said collection means comprises an elongate pan extending over the length of said upstream section and disposed between said perforate support and said lower reach.

6. An apparatus, according to claim 1, further comprising a first jet monitor carried by said apparatus at the upstream end of the belt conveyor for dislodging material from a mine within which the apparatus is working and a second jet monitor carred by said apparatus intermediate said upstream and downstream sections of the belt conveyor for breaking up dislodged mined material disposed around and on said apparatus.

7. A method of treating and conveying hydraulically mined aggregate, said method comprising: conveying said aggregate over an elongate perforate continuous loop belt conveyor having upstream and downstream sections and a reach extending over the length of said sections, the belt of said conveyor being sufficiently open to permit the substantially unrestricted passage of mined aggregate therethrough and having an upstream support extending beneath said reach over the length of said upstream section and a downstream support extending beneath said reach over the length of said downstream section, said upstream support having openings therein sized to permit fluid and aggregate of a pumpable size to pass therethrough while preventing the passage therethrough of aggregate greater than pumpable size, said downstream support being substantially imperforate whereby aggregate carried by said downstream section is supported on said downstream support and discharges over the distal end of said section; subjecting aggregate of greater than a predetermined size to breakage at a point disposed intermediate said upstream and downstream sections to reduce the size of said aggregate; collecting fluid and aggregate which passes through the upstream support and conveying the same away by pumping; conveying over the downstream section of the conveyor the aggregate remaining on the conveyor after breakage intermediate said upstream and downstream sections; and, discharging aggregate conveyed on said downstream section over the distal end thereof onto a conveyor disposed in receiving relationship to said downstream section.

8. A method, according to claim 7, further comprising the step of hydraulically reducing oversized mined aggregate in size prior to or during the conveyance thereof over the continuous conveyor.

* * * * *